US007750880B2

(12) United States Patent
Ha et al.

(10) Patent No.: US 7,750,880 B2
(45) Date of Patent: Jul. 6, 2010

(54) AUTOMATIC DIGITAL VARIABLE RESISTOR AND DISPLAY DEVICE HAVING THE SAME

(75) Inventors: Young-suk Ha, Gunpo-si (KR); Jin-woo Park, Yongin-si (KR)

(73) Assignee: Samsung Electronics CPO., Ltd., Suwon-SI (KR)

( * ) Notice: Subject to any disclaimer, the term of this patent is extended or adjusted under 35 U.S.C. 154(b) by 803 days.

(21) Appl. No.: 11/552,217

(22) Filed: Oct. 24, 2006

(65) Prior Publication Data

US 2007/0097757 A1 May 3, 2007

(30) Foreign Application Priority Data

Oct. 28, 2005 (KR) ..... 10-2005-0102322

(51) Int. Cl.
*G09G 3/36* (2006.01)

(52) U.S. Cl. ..... 345/94; 345/87; 345/98; 345/99

(58) Field of Classification Search ..... 345/55, 345/76, 84, 87, 89, 94, 98, 99, 100, 204, 345/205, 206, 214, 690, 77
See application file for complete search history.

(56) References Cited

U.S. PATENT DOCUMENTS 6,275,209 B1 * 8/2001 Yamamoto ..... 345/95
6,388,716 B1 * 5/2002 Tsuzuki et al. ..... 348/687
6,593,934 B1 * 7/2003 Liaw et al. ..... 345/590
6,731,259 B2 * 5/2004 Yer et al. ..... 345/89

FOREIGN PATENT DOCUMENTS

| | | |
|---|---|---|
| KR | 1999-0062856 | 7/1999 |
| KR | 1019990062856 | 7/1999 |
| KR | 100508038 | 8/2005 |

* cited by examiner

*Primary Examiner*—My-Chau T Tran
(74) *Attorney, Agent, or Firm*—F. Chau & Associates, LLC

(57) ABSTRACT

An automatic digital variable resistor capable of preventing failure in a liquid crystal display panel and an LCD having the same are provided. The automatic digital variable resistor comprises a programmable memory in which an intermediate value of n-bit data is stored, wherein (n≧2) and a voltage adjuster adjusting the intermediate value stored in the memory in response to an external control signal and outputting an analog voltage value corresponding to the adjusted intermediate value, wherein the voltage adjuster further outputs an analog voltage value corresponding to the intermediate value read from the memory when the intermediate value is a maximum or minimum value of n-bit data.

15 Claims, 7 Drawing Sheets

AUTOMATIC DIGITAL VARIABLE RESISTOR AND DISPLAY DEVICE HAVING THE SAME

CROSS-REFERENCE TO RELATED APPLICATION

This application claims priority to Korean Patent Application No. 10-2005-0102322 filed on Oct. 28, 2005 in the Korean Intellectual Property Office, the contents of which are herein incorporated by reference in their entirety.

BACKGROUND OF THE INVENTION

1. Field of the Invention

The present invention relates to an automatic digital variable resistor and a display device including the same, and more particularly, to an automatic digital variable resistor designed to prevent failure in a liquid crystal display (LCD) panel and an LCD having the same.

2. Description of the Related Art

A liquid crystal display ("LCD") is a commonly used flat panel display and offers a variety of characteristics, including low power consumption, slim and lightweight design, a low driving voltage compared to other displays.

An LCD panel can include an upper panel with a common electrode and a color filter, a lower panel with a thin film transistor ("TFT") and a pixel electrode, and a liquid crystal layer sandwiched between the upper panel and the lower panel. In the LCD, an electric field is created by applying different electric potentials to the pixel electrode and the common electrode, which alters arrangement of liquid crystal molecules to control the transmittance of light. In this way, the LCD displays a desired image.

The LCD can include the LCD panel, a driving voltage generator, a, gate driver, a gamma voltage generator, a data driver, and a timing controller.

The LCD panel includes a plurality of gate lines and a plurality of data lines intersecting the plurality of gate lines. The driving voltage generator produces a gate-on voltage, a gate-off voltage, and a common voltage. The gate driver is connected to the plurality of gate lines of the LCD panel and applies a gate signal including the gate-on voltage and the gate-off voltage to the plurality of gate lines. The gamma voltage generator produces two sets of gamma voltages, i.e., gamma voltages with positive and negative polarities, which are associated with a change in the transmittance of a unit pixel, and applies the gamma voltages to the LCD panel. The data driver is coupled to the plurality of data lines of the LCD panel, generates a plurality of gray scale voltages based on the plurality of gamma voltages received from the gamma voltage generator, selects gray scale voltages, and applies the selected gray scale voltages to each pixel as data signals.

The timing controller receives image data and input control signals controlling the display of the image data, such as vertical synchronization signal Vsync and horizontal synchronization signal Hsync, main clock MCLK and data enable signal DE, from an external graphic controller. The timing controller also generates a gate control signal and a data control signal in response to the input control signals, processes R, G, B image signals suitably according to the operation conditions of the LCD panel, and provides the gate control signal and the data control signal and the resulting image signals R', G', and B' to the gate driver and the data driver, respectively.

The driving voltage generator includes a digital variable resistor generating a common voltage. The digital variable resistor includes a memory in which an intermediate value of n-bit data is initially stored. The digital variable resistor receives operating voltage $V_{DD}$ and control signal CTL, reads the intermediate value stored in the memory in response to the control signal CTL, and outputs an analog voltage corresponding to the intermediate data value.

However, when data is stored in the memory, the memory is reset to a maximum value of n-bit data instead of the intermediate value. Furthermore, even if the intermediate value of n-bit data is normally stored in the memory, the minimum or maximum value of n-bit data can be read from the memory when static electricity or read failure occurs. This may cause flickering on an LCD and may result in noise in gray scales.

SUMMARY OF THE INVENTION

Embodiments of the present invention provide an automatic digital variable resistor capable of preventing failure in a liquid crystal display (LCD) and an LCD including the automatic digital variable resistor.

According to an aspect of the present invention, there is provided an automatic digital variable resistor comprising a programmable memory in which an intermediate value of n-bit data is stored, wherein ($n \geqq 2$) and a voltage adjuster adjusting the intermediate value stored in the memory in response to an external control signal and outputting an analog voltage value corresponding to the adjusted intermediate value, wherein the voltage adjuster further outputs an analog voltage value corresponding to the intermediate value read from the memory when the intermediate value is a maximum or minimum value of n-bit data.

According to another aspect of the present invention, there is provided an automatic digital variable resistor comprising a programmable memory in which an intermediate value of n-bit data is stored, wherein $n \geqq 2$, an interface controller reading the intermediate data value stored in the memory or adjusting the intermediate data value in response to an external control signal, a digital-to-analog (D/A) converter converting the intermediate data value into an analog voltage value corresponding to the intermediate data value when the intermediate data value read from the memory during a read operation is a maximum or minimum value of n-bit data and an output unit amplifying the analog voltage value.

According to another aspect of the present invention, there is provided an automatic digital variable resistor comprising a programmable memory in which an intermediate data value of n-bit data is stored, wherein $n \geqq 2$, an interface controller reading the intermediate data value stored in the memory or adjusting the intermediate data value in response to a control signal, an error detector adjusting the intermediate data value to an adjusted intermediate data value of n-bit data when the intermediate data value read from the memory is a maximum or minimum value of n-bit data and a digital-to-analog (D/A) converter outputting an analog voltage value corresponding to the read or adjusted intermediate data value and an output unit amplifying the analog voltage value.

According to another aspect of the present invention, there is provided an LCD comprising an LCD panel including a plurality of gate lines, a plurality of data lines intersecting the plurality of gate lines, and a plurality of pixels electrically connected to the plurality of data lines, a timing controller generating control signals controlling the LCD panel, a driving voltage generator including an automatic digital variable resistor, which generates a plurality of driving voltages in response to the control signals received from the timing controller, the automatic digital variable resistor including a programmable memory in which an intermediate value of n-bit data is stored, (n≧2) and a voltage adjuster adjusting the intermediate value stored in the memory in response to a control signal and outputting an analog voltage value corresponding to the adjusted intermediate value, wherein the voltage adjuster further outputs an analog voltage value corresponding to the intermediate value read from the memory when the intermediate data value is a maximum or minimum value of n-bit data, and a gate driver receiving the driving voltages and applying the driving voltages to the plurality of gate lines.

According to still another aspect of the present invention, there is provided an LCD including an LCD panel including a plurality of gate lines, a plurality of data lines intersecting the plurality of gate lines, and a plurality of pixels electrically connected to the plurality of data lines, a timing controller that generates control signals controlling the LCD panel, a driving voltage generator including an automatic digital variable resistor, which generates plurality of driving voltage in response to the control signals received from the timing controller, wherein the automatic digital variable resistor comprises a programmable memory in which an intermediate value of n-bit data is stored, wherein (n≧2) and an interface controller that reads the intermediate data value stored in the memory or adjusts the intermediate data value in response to an external control signal, a digital-to-analog (D/A) converter that outputs an analog voltage value corresponding to the adjusted intermediate data value, and outputs an analog voltage value corresponding to the read intermediate data value when the read intermediate data value is a maximum or minimum value of n-bit data, and an output unit amplifying an analog voltage value, and a gate driver that receives the driving voltages and applies the driving voltage to the plurality of gate lines.

According to a further aspect of the present invention, there is provided an LCD including an LCD panel including a plurality of gate lines, a plurality of data lines intersecting the plurality of gate lines, and a plurality of pixels electrically connected to the plurality of data lines, a timing controller that generates control signals controlling the LCD panel, a driving voltage generator including an automatic digital variable resistor, which generates a plurality of driving voltages in response to the control signals received from the timing controller, the automatic digital variable resistor including a programmable memory in which an intermediate value of n-bit data is stored, wherein (n≧2) an interface controller that reads the intermediate data value stored in the memory or adjusts the intermediate data value in response to a control signal, an error detector that adjusts the intermediate data value to an adjusted intermediate data value of n-bit data when the intermediate data value read from the memory is a maximum or minimum value of n-bit data, and a digital-to-analog (D/A) converter that outputs an analog voltage value corresponding to the read or adjusted intermediate data value and an output unit amplifying the analog voltage value, and a gate driver that receives the driving voltages and applies the driving voltages to the plurality of gate lines.

BRIEF DESCRIPTION OF THE DRAWINGS

Exemplary embodiments of the present invention can be understood in more detail from the following descriptions taken in conjunction with the attached drawings in which.

DETAILED DESCRIPTION OF THE EXEMPLARY EMBODIMENTS

Exemplary embodiments of the present invention will now be described more fully hereinafter with reference to the accompanying drawings. The present invention may, however, be embodied in many different forms and should not be construed as being limited to the embodiments set forth herein.

A liquid crystal display (LCD) according to an embodiment of the present invention will now be described more fully with reference to the accompanying drawings.

Figure 1:
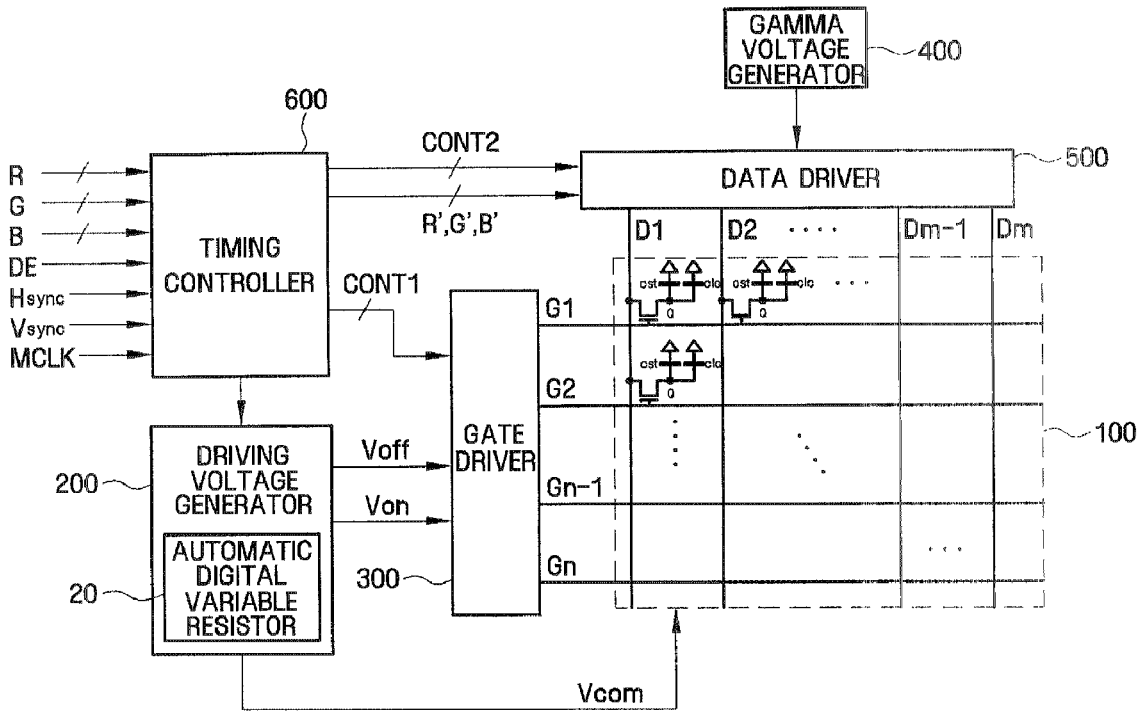
FIG. 1 is a block diagram of a liquid crystal display (LCD) according to an embodiment of the present invention.

FIG. 1 is a block diagram of an LCD according to an embodiment of the present invention.

Referring to FIG. 1, the LCD includes an LCD panel 100, a driving voltage generator 200, a gate driver 300, a gamma voltage generator 400, a data driver 500, and a timing controller 600.

As shown in FIG. 1, the LCD panel 100 includes a plurality of gate lines G1 through Gn and a plurality of data lines D1 through Dm and a plurality of pixels electrically connected to the plurality of data lines Gn and D1 through Dm.

Each of the plurality of pixels includes a switching element Q connected to a corresponding one of the plurality of gate lines G1 through Gn and a corresponding one of the plurality of data lines D1 through Dm and a liquid crystal capacitor $C_{LC}$ and a storage capacitor $C_{ST}$ connected to the switching element Q. The storage capacitor $C_{ST}$ may be omitted.

The switching element Q is formed on a thin film transistor (TFT) substrate. The switching element Q is a three-terminal device including a control terminal connected to the corresponding gate line, an input terminal connected to the corresponding data line, and an output terminal connected to the liquid crystal capacitor $C_{LC}$ and the storage capacitor $C_{ST}$.

The liquid crystal capacitor $C_{LC}$ has two electrodes, i.e., a pixel electrode on the TFT substrate and a common electrode on a color filter substrate, and a liquid crystal layer acting as a dielectric material between the pixel electrode and the common electrode. The pixel electrode is connected to the switching element Q and a common electrode to which a common voltage Vcom is applied is disposed on the color filter substrate. The common electrode may be provided on the TFT substrate. In this case, both the pixel electrode and the common electrode are linear or bar shaped.

The storage capacitor $C_{ST}$ is formed by overlapping a separate signal line (not shown) on the TFT substrate with the pixel electrode and the common voltage Vcom is applied to the separate signal line (separate wire type) or by overlapping the pixel electrode with the gate line (previous gate type) through an insulating material.

Each pixel can represent color to display a color image. To this end, a red (R), green (G), or blue (B) color filter may be disposed on a region on the color filter substrate corresponding to a pixel electrode, and/or formed above or below the pixel electrode on the TFT substrate.

A polarizer (not shown) polarizing light is attached to the outside of either or both of TFT substrate and color filter substrate of the LCD panel 100.

The driving voltage generator 200 produces a plurality of driving voltages. i.e., a gate-on voltage Von, a gate-off voltage Voff, and a common voltage Vcom. The driving voltage generator 200 includes an automatic digital variable resistor 20 to generate an optimal common voltage, which will be described in more detail later with reference to FIG. 2.

The gate driver 300 is connected to the plurality of gate lines G1 through Gn of the LCD panel 100 and applies a gate signal including the gate-on voltage Von and the gate-off voltage Voff to the gate lines G1 through Gn.

The gamma voltage generator 400 generates two sets of gamma voltages with positive and negative polarities that induce a change in transmittance of a pixel. Positive and negative voltages have opposite polarities with respect to the common voltage Vcom and are alternately provided to the LCD panel during inversion operation.

The data driver 500 is coupled to the plurality of data lines D1 through Dm of the LCD panel 100 and includes an integrated circuit (IC). The data driver 500 generates gray scale voltages based on the plurality of gamma voltages received from the gamma voltage generator 400, selects gray scale voltages, and applies the selected gray scale voltages to each pixel as data signals.

The timing controller 600 generates control signals controlling the operation of the gate driver 300 and the data driver 500 and provides the appropriate control signals to the gate driver 300 and the data driver 500.

The timing controller 600 receives R, G, and B image signals and an input control signal controlling the display of the R, G, and B image signals, such as a vertical synchronization signal Vsync and a horizontal synchronization signal Hsync, main clock MCLK and data enable signal DE from an external graphic controller (not shown). The timing controller 600 also generates a gate control signal CONT1 and a data control signal CONT2 in response to the input control signal, processes the R, G, B image signals suitably according to the operation conditions of the LCD panel 100, and provides the gate control signal CONT1 and the data control signal CONT2 and the resulting image signals R', G', and B' to the gate driver 300 and the data driver 500, respectively.

The gate control signal CONT1 includes a vertical synchronization start signal STV for indicating the start of output of a gate-on pulse (gate-on voltage interval), a gate clock signal CPV for controlling the output time of the gate-on pulse, and an output enable signal OE for defining the width of the gate-on pulse. The output enable signal OE and the gate clock, signal CPV are provided to the driving voltage generator 200.

The data control signal CONT2 includes a horizontal synchronization signal STH for indicating the start of input of the image data R', G', and B', a load signal LOAD for instructing application of appropriate data voltages to the data lines D1 through Dm, an inversion, signal RVS for reversing the polarity of the data voltages with respect to the common voltage Vcom (also referred to as "the polarity of the data voltages"), and a data clock signal HCLK.

The data driver 500 sequentially receives image data R', G', and B' corresponding to one row of pixels in response to the data control signal CONT2 received from the timing controller 600 and adjusts the image data R', G', and B' into data voltages selected among gray scale voltages.

The gate driver 300 sequentially applies a gate-on voltage Von to each of the plurality of gate lines G1 through Gn in response to the gate control signal CONT1 received from the timing controller 600 in order to turn on the switching element Q connected to the gate line.

While the gate-on voltage Von is applied to one of the gate lines G1 though Gn so that one row of switching elements Q connected to the gate line are turned on ('one horizontal period' or '1H'), the data driver 500 applies each data voltage to a corresponding data line. The 1H is equal to one period of horizontal synchronization signal Hsync, data enable signal DE, or gate clock signal CPV. The data voltage applied to the corresponding data line is then supplied to a corresponding pixel through the turned-on switching element Q.

An electric field created by the pixel electrode and the common electrode alters the direction of liquid crystal alignment, thus changing the polarization of light passing through the liquid crystal layer. The change in polarization results in change in the amount of transmittance of light transmitted through a polarizer disposed on the TFT substrate and the color filter substrate.

In this way, gate-on voltage Von is sequentially applied to all of the gate lines G1 through Gn during one frame, so that data voltages are applied to all the pixels. When the next frame starts after one frame finishes, the inversion signal RVS applied to the data driver 600 is controlled in such a way as to reverse the polarity of data voltages with respect to that of data voltages in the previous frame, which is called "frame inversion". The inversion signal RVS may be also controlled in such a way as to reverse the polarity of data voltages flowing in a data line in one frame according to characteristics of the inversion signal RVS, which is called "line inversion", or to reverse the polarity of the data voltages in one packet, which is called "dot inversion".

Figure 2:
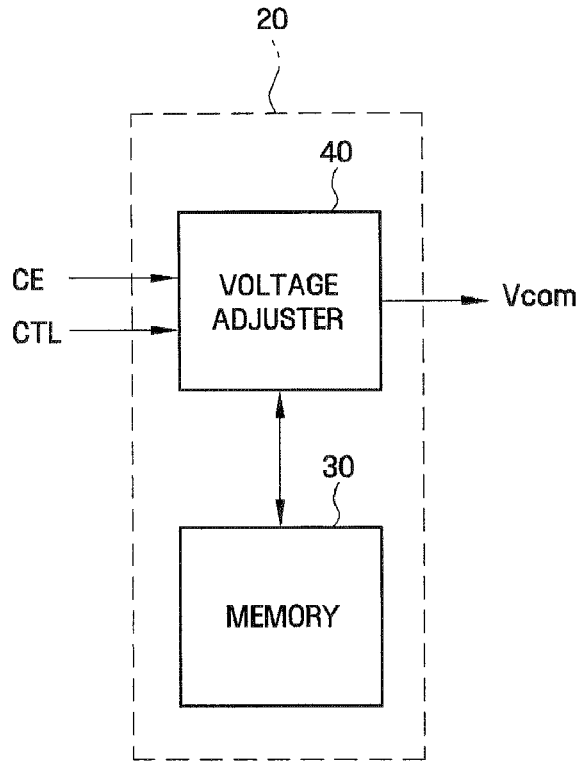
FIG. 2 is a block diagram of an automatic digital variable resistor according to an embodiment of the present invention.

FIG. 2 is a block diagram of an automatic digital variable resistor 20 according to an embodiment of the present invention.

Referring to FIG. 2, the automatic digital variable resistor 20 includes a memory 30 and a voltage adjuster 40.

An intermediate value of n-bit data ($n \geqq 2$) is initially stored in the memory 30. For example, "1000000" as the intermediate value of 7-bit data may be initially stored in the memory 30. The memory 30 is a programmable device such as an electrically erasable programmable read only memory (EEPROM).

The voltage adjuster 40 outputs an analog voltage value Vout corresponding to the intermediate data value stored in the memory 30 in response to external control signal CTL or adjusts the intermediate value stored in the memory 30 to output an analog voltage value Vout corresponding to the adjusted intermediate value. Here, an analog voltage value is an optimal common voltage Vcom. When a maximum or minimum value of n-bit data is read from the memory 30 instead of an intermediate data value during a read operation due to external static electricity or read failure, the voltage adjuster 40 also outputs an analog voltage value Vout corresponding to the intermediate data value of n-bit data.

Figure 3:
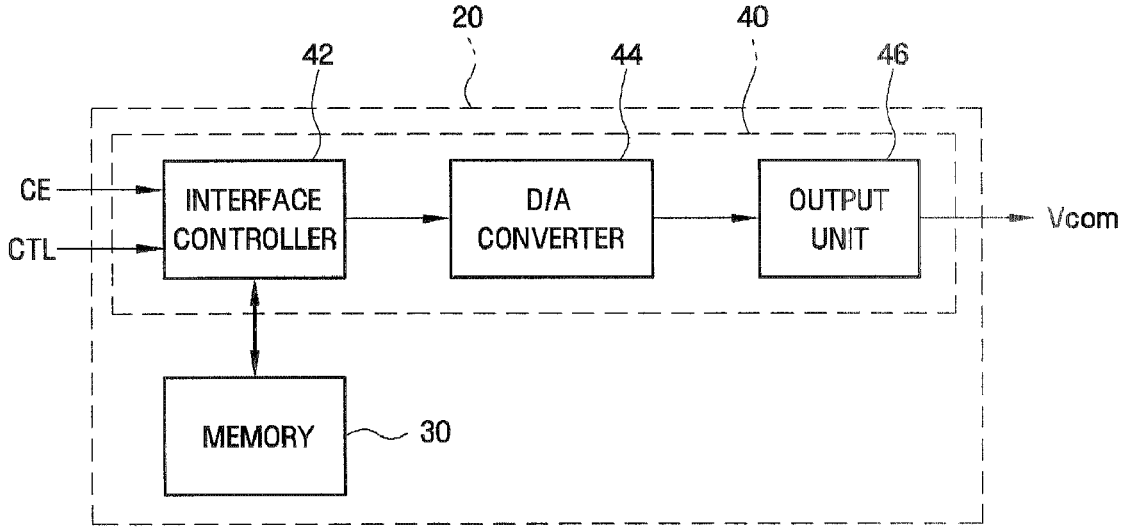
FIG. 3 is an internal block diagram of a voltage adjuster according to an embodiment of the present invention.

FIG. 3 is an internal block diagram of the voltage adjuster 40 according to an embodiment of the present invention.

Referring to FIG. 3, the voltage adjuster 40 includes an interface controller 42, a digital-to-analog (D/A) converter 44, and an output unit 46.

The interface controller 42 receives a control enable signal CE and a control signal CTL and provides an intermediate data value stored in the memory 30 to the D/A converter 44 in response to the control signal CTL. In addition, the interface controller 42 adjusts the intermediate data value being stored in the memory 30 according to the control signal CTL.

In this case, the control enable signal CE is used to enable the digital variable resistor 20 and is coupled to an operating voltage $V_{DD}$. To disable the digital variable resistor 20, the control enable signal CE should be coupled to a ground GND. The control signal CTL applied by the timing controller 600 is a pulsed signal having logic "high" and "low" levels.

A digital-to-analog (D/A) converter 44 outputs an analog voltage value corresponding to the intermediate data value being stored in the memory 30 according to the control signal CTL. When a maximum or minimum value of n-bit data is read from the memory 30 instead of an intermediate data value during a read operation due to external static electricity or read failure, the D/A converter 44 outputs an analog voltage value Vout corresponding to the intermediate data value of n-bit data. A D/A converter 44 includes a data-converter (not shown) that forcibly converts the maximum data or the minimum data value of n-nit data into an intermediate data value. The data converter outputs an intermediate data value of n-bit data, and the D/A converter 44 an analog voltage value Vout corresponding to the intermediate data value of n-bit data.

For example, when a maximum or minimum value of n-bit data is read from the memory 30 instead of an intermediate data value during a read operation due to external static electricity or read failure, the D/A converter 44 receives a maximum value, i.e., "1111111" or minimum value, i.e., "0000000" of 7-bit data.

Then, a digital-to-analog (D/A) converter 44 outputs an analog voltage value corresponding to the intermediate data value of 7-bit data, e.g., "1000000".

An output unit 46 amplifies an analog voltage value and outputs the amplified common voltage Vcom through a transistor.

Figure 4:
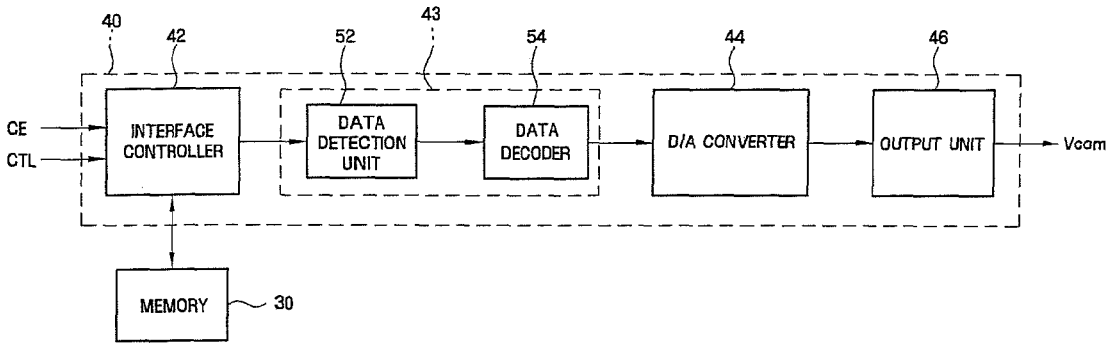
FIG. 4 is an internal block diagram of a voltage adjuster according to an embodiment of the present invention.

FIG. 4 is an internal block diagram of the voltage adjuster 40 according to an embodiment of the present invention.

Referring to FIG. 4, the voltage adjuster 40 includes an interface controller 42, an error detector 43, a digital-to-analog (D/A) converter 44, and an output unit 46.

The interface controller 42 receives a control enable signal CE and a control signal CTL and provides an intermediate data value stored in the memory 30 to the error detector 43 in response to the control signal CTL. In addition, the interface controller 412 adjusts the intermediate data value being stored in the memory 30 in response to the control signal CTL.

In this case, the control enable signal CE is used to enable the digital variable resistor 20 and is coupled to an operating voltage $V_{DD}$. To disable the digital variable resistor 20, the control enable signal CE should be coupled to a ground GND. The control signal CTL applied by the timing controller 600 is a pulsed signal having logic "high" and "low" levels.

When a maximum or minimum value of n-bit data is read from the memory 30 due to external static electricity or read failure while reading an intermediate data value during a read operation in response to the external control signal CTL, the error detector 43 outputs an analog voltage value corresponding to the intermediate value of n-bit data.

The error detector 43 includes a data detector 52 and a data decoder 54. The data detector 52 outputs a logic "high" signal when the intermediate data value is the maximum or minimum value of n-bit data while outputting a logic "low" signal when the intermediate data value is neither maximum nor minimum value of n-bit data. The data decoder 54 inverts all bits of the intermediate data value except for the most significant bit (MSB) and outputs the resultant value when the data detector 52 outputs a logic "high" signal, while outputting the intermediate data value when the data detector 52 outputs a logic "low" signal. The operation of the data detector 52 and the data decoder 54 will now be described in more detail with reference to FIGS. 7-9.

Then, a digital-to-analog (D/A) converter 44 outputs an analog voltage value corresponding to the intermediate data value.

Output unit 46 amplifies an analog voltage value and outputs amplified common voltage Vcom through transistor.

Figure 5:
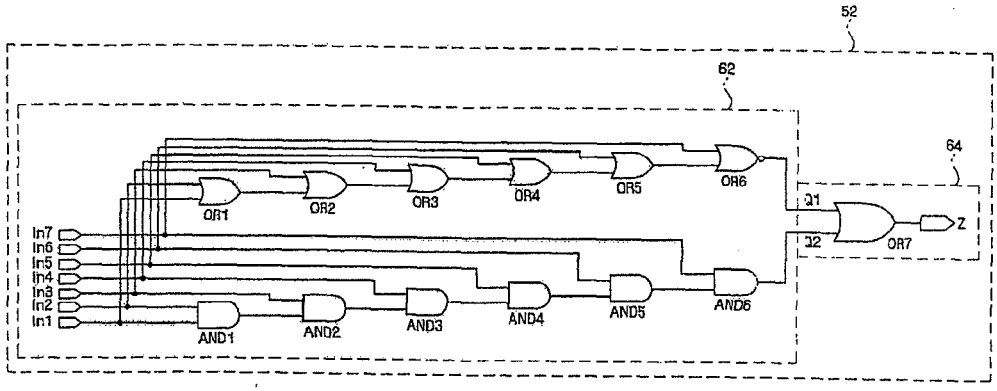
FIG. 5 is a circuit diagram of a data detection unit according to an embodiment of the present invention.

FIG. 5 is a circuit diagram of the data detector 52 according to an embodiment of the present invention.

Referring to FIG. 5, the data detector 52 includes a first detector 62 having a plurality of AND gates AND1 through AND6 and a plurality of OR gates OR1 through OR6 and a second detector 64. The first detector 62 determines whether the intermediate data value received from the interface controller 42 is a maximum or minimum value of n-bit data and the second detector 64 outputs the result of determination.

When the intermediate data value received from the interface controller is input to input signal terminals In1 through In7, the plurality of AND gates AND1 through AND6 and the plurality of OR gates OR1 through OR6 perform logic operations on input signals to output signals Q1 and Q2. For example, when the intermediate data value is "1111111", both the output signals Q1 and Q2 of the AND gates AND1 through AND6 and OR gates OR1 through OR6 have logic "high" levels.

When the output signals Q1 and Q2 of the first detector 62 are applied to an OR gate OR7 as input signals, the second detector 64 performs a logic operation on the input signal as to output a signal Z. Because the second detector 64 includes the OR gate OR7, the level of output signal Z is high when one of the output signals Q1 and Q2 is a logic "high" signal. When the output signal Z is a logic "high" signal, the input intermediate data value is the maximum or minimum value of n-bit data.

Figure 6:
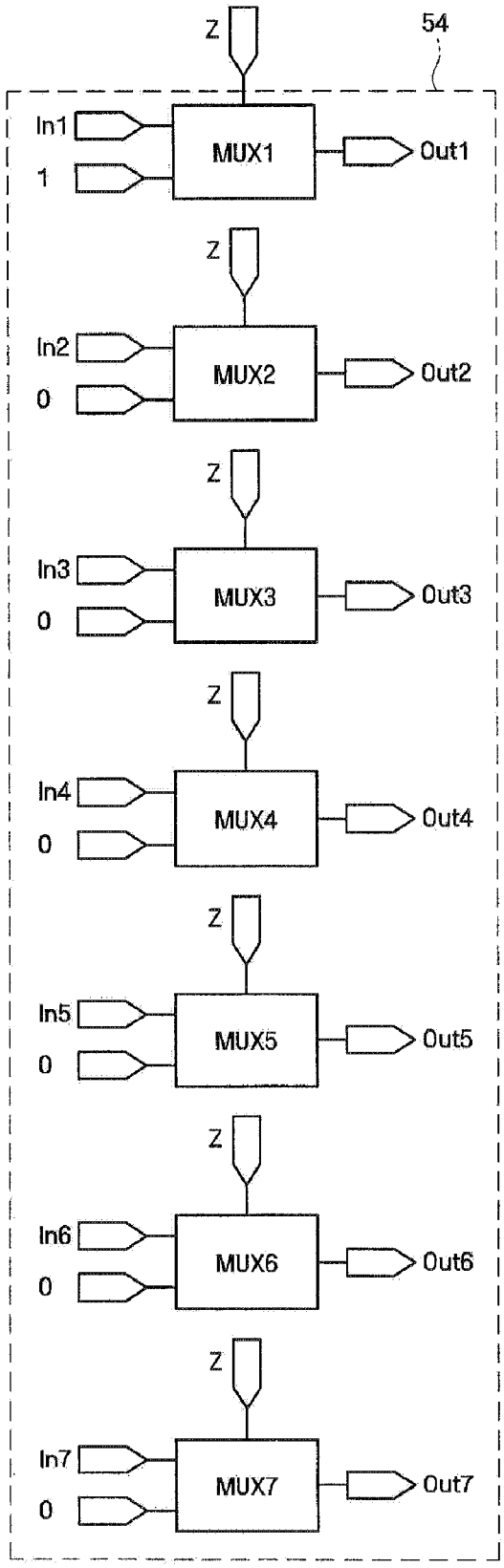
FIG. 6 is a circuit diagram of a data decoder according to an embodiment of the present invention.

FIG. 6 is a circuit diagram of the data decoder 54 according to an embodiment of the present invention.

Referring to FIG. 6, the data decoder 54 includes a plurality of multiplexers, MUX1 through MUX7 selecting an input signal in response to the output signal Z of the data detector 52. In this case, an intermediate data value provided by the interface controller 42 or a predetermined intermediate data value of n-bit data can be selected as the input signal. An intermediate data value of n-bit data may be preset to "1000000".

When the output signal Z of the data detector 52 is a logic "low" signal, the multiplexers MUX1 through MUX7 output intermediate data values, i.e., input signals In1 through In7 to output signal terminals Out1 through Out7. Conversely, when the output signal Z is a logic "high" signal, the preset intermediate data value "1000000" of n-bit data is output.

Figure 7:
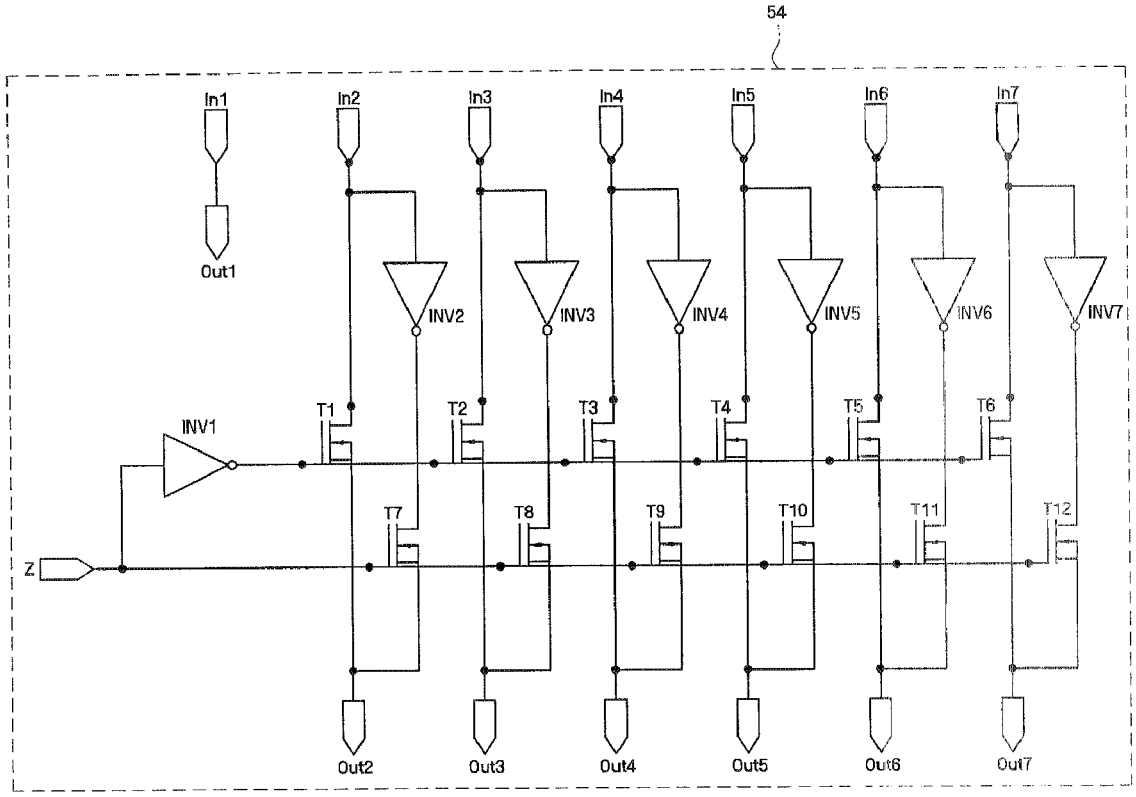
FIG. 7 is an internal circuit diagram of a data decoder according to an embodiment of the present invention.

FIG. 7 is an internal circuit diagram of the data decoder 54 according to an embodiment of the present invention.

Referring to FIG. 7, an internal circuit of the data decoder 54 includes a plurality of inverters INV1 through INV7 inverting input signals and outputting the inverted signals and a plurality of NMOS transistors T1 through T12.

When the output signal ZZ of the data detector 52 is a logic "low" signal, the inverter INV1 outputs a logic "high" signal that is then applied to gate terminals of the NMOS transistors T1 through T6 so that the NMOS transistors T1 through T6 are turned on. Then, intermediate data values input from the interface controller 42, i.e., input signals In2 through In7, are output to the output signal terminals Out2 through Out7. In this case, the input signal In1 is output to the output signal terminal Out1 and a logic "low" signal is applied to gate terminals of NMOS transistors T7 through T12 so that the NMOS transistors T7 through T12 are turned off. For example, when the output signal Z of the data detector 52 is a logic "low" signal and the input intermediate data value is "0000001", the inverter INV1 outputs a logic "high" signal that is then applied to the gate terminals of the NMOS transistors T1 through T6 so that the NMOS transistors T1 through T6 are turned on. Then, the input intermediate data, value "0000001" is output to the output signal terminals Out1 through Out7.

When the output signal Z of the data detector 52 is a logic "high" signal, the logic "high" signal is applied to the gate terminals of the NMOS transistors T7 through T12 so that the NMOS transistors T7 through T12 are turned on. Then, intermediate data values input from the interface controller 42, i.e., the input signals In2 through In7, are inverted by the inverters INV2 through INV7 and output to the output signal terminals Out2 through Out7. In this case, the inverter INV1 outputs a logic "low" signal that is then applied to the gate terminals of the NMOS transistors T1 through T6 so that the NMOS transistors T1 through T6 are turned off.

Conversely, when the output signal Z of the data detector 52 is a logic "high" signal and the input intermediate data value is "1111111", logic "high" signal is applied to the gate terminals of the NMOS transistors T7 through T12, causing the NMOS transistors T1 through T6 to turn on. Then, "1000000", which is the intermediate value of n-bit data, is output to the output signal terminals Out2 through Out7 via the inverters INV2 through INV7. In this case, the MSB of the input intermediate data value remains intact.

Figure 8:
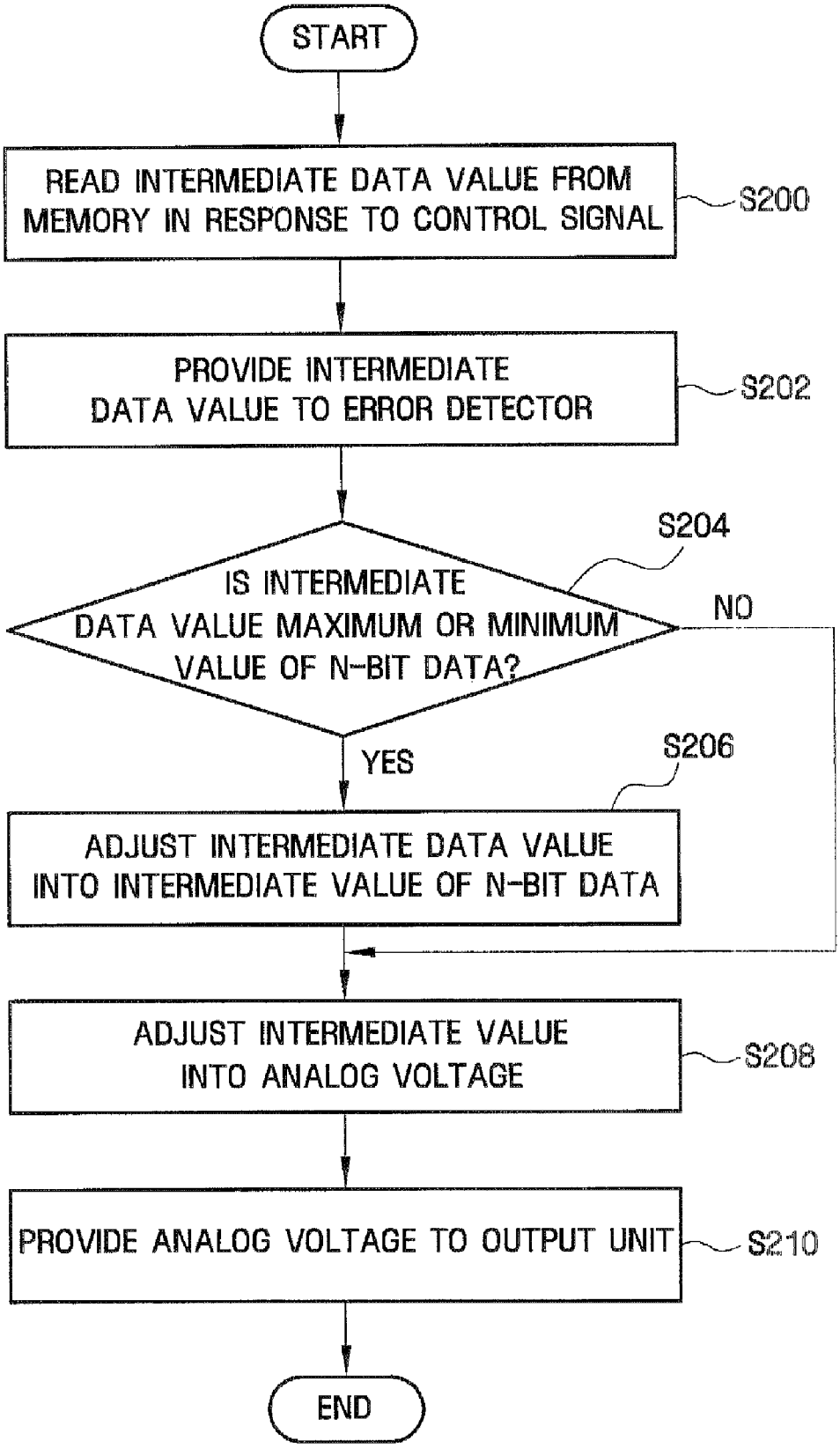
FIG. 8 is a flowchart illustrating the operation of an automatic digital variable resistor according to an embodiment of the present invention.

FIG. 8 is a flowchart illustrating the operation of the automatic digital variable resistor 20 according to an embodiment of the present invention.

Referring to FIG. 8, in step S200, the interface controller 42 receives control enable signal CE and control signal CTL and reads an intermediate data value stored in the memory 30 in response to the control signal CTL. In step S202, the interface controller 42 provides the intermediate data value read from the memory 30 to the error detector 43.

In step S204, the error detector 43 determines whether the intermediate data value is a maximum or minimum value of n-bit data. In step S206, when the intermediate data value is the maximum or minimum value of n-bit data, the error detector 43 adjusts the input intermediate data value to an intermediate value of n-bit data. For example, if the intermediate data value "1111111" is input to the error detector 43, the error detector 43 may adjust the maximum data value "1111111" of 7-bit data to an intermediate value "1000000" of 7-bit data. In step S208, the error detector 43 provides the adjusted intermediate data value to the D/A converter 46 and the D/A converter 46 converts the received intermediate data value into an analog voltage value. In step S210, the D/A converter 46 provides the analog voltage value to the output unit 48. Output unit 48 amplifies an analog voltage value and outputs amplified common voltage Vcom through transistor.

On the other hand, when the intermediate data value read from the memory 30 is neither the maximum nor minimum value of n-bit data in step S204, the intermediate data value is provided to the D/A converter 46 and step S206 is not required. In steps S208 and S210, the D/A converter 46 converts the intermediate data value into an analog voltage value and provides the analog voltage value to the output unit 48. Output unit 48 amplifies an analog voltage value and outputs amplified common voltage Vcom through transistor.

Figure 9:
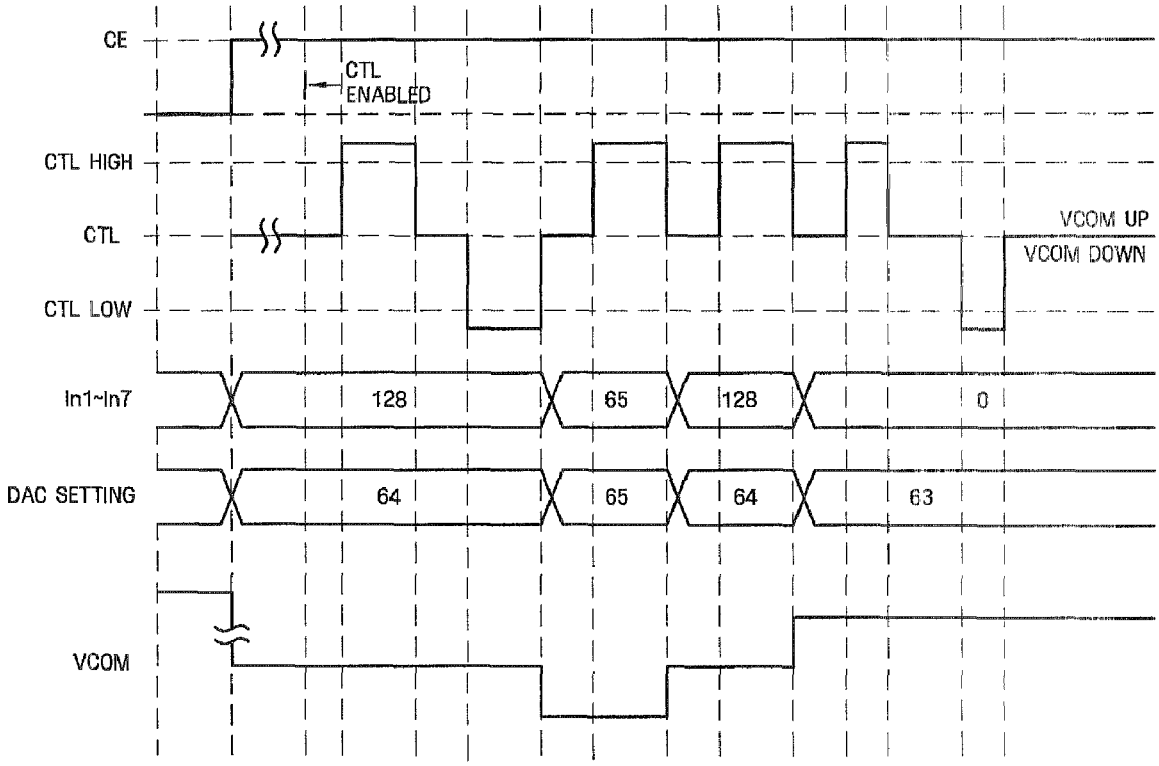
FIG. 9 is a timing diagram for an automatic digital variable resistor according to an embodiment of the present invention.

FIG. 9 is a timing diagram for the automatic digital variable resistor 20 according to an embodiment of the present invention.

Referring to FIG. 9, the automatic digital variable resistor 20 receives control enable signal CE and control signal CTL. The control signal CTL is enabled after predetermined delay time has lapsed and a pulsed signal having logic "high" level and logic "low" level with respect to a predetermined voltage is input as the control signal CTL. The control enable signal CE is coupled to operating voltage $V_{DD}$ to enable the automatic digital variable resistor 20 and the control signal CTL is applied from the timing controller 600. For example, the operating voltage may have a range from 2.6 V to 3.6 V and the control signal CTL has a logic "high" level and a logic "low" level with respect to $V_{DD}/2$. In this case, the logic "high" level of the control signal CTL has a range from $V_{DD}*0.70$ to $V_{DD}*0.82$ while the logic "low" level has a range from $V_{DD}*0.20$ to $V_{DD}*0.32$.

When the control signal CTL is input, the interface controller 42 reads an intermediate data value stored in the memory 30 according to the control signal CTL and provides the read intermediate data value to the error detector 43. In1~In7 denote intermediate data values provided to the error detector 43. In this case, the intermediate data value 64 of 7-bit data is prestored in the memory 30. Thus, when the automatic digital variable resistor is enabled, the intermediate data value 64 is read from the memory 30. However, when external static electricity or read failure occurs, the interface controller 42 may read 128 or 0 instead of 64.

When the interface controller 42 reads 128 or 0 as the intermediate data value, the error detector 43 checks whether the intermediate data value read from the memory 30 is a maximum or minimum value of n-bit data. In this case, the error detector 43 adjusts the maximum value 128 and minimum value 0 of 7-bit data to 64 and 63, respectively DAC SETTING denotes an intermediate data value provided to the D/A converter 46 by the error detector 43. Referring to FIG. 9, first and fourth DAC SETTING values indicate the adjusted intermediate data values 64 and 63. The DAC SETTING data values are adjusted into analog voltage values and then output to the output unit 48.

As described above, an automatic digital variable resistor and an LCD including the same according to the embodiments of present invention can avoid flickering on an LCD panel and noise in gray scale images due to external static electricity or failure during a memory read operation.

Although the illustrative embodiments have been described herein with reference to the accompanying drawings, it is to be understood that the present invention is not limited to those precise embodiments, and that various other changes and modifications may be affected therein by one of ordinary skill in the related art without departing from the scope or spirit of the invention. All such changes and modifications are intended to be included within the scope of the invention as defined by the appended claims.

What is claimed is:

1. An automatic digital variable resistor comprising:

a programmable memory in which an intermediate value of n-bit data is stored, wherein $n \geqq 2$; and a voltage adjuster adjusting the intermediate value stored in the memory in response to a control signal and outputting an analog voltage value corresponding to the adjusted intermediate value, wherein the voltage adjuster further outputs an analog voltage value corresponding to the intermediate value when the intermediate value read from the memory during a read operation is maximum or minimum value of n-bit data, wherein the control signal is a pulsed signal having logic high and low levels with respect to a predetermined voltage.

2. The automatic digital variable resistor of claim 1, wherein the memory is an electrically erasable programmable read only memory (EEPROM).

3. An automatic digital variable resistor comprising:

a programmable memory in which an intermediate value of n-bit data is stored, wherein n≧2;

an interface controller reading the intermediate data value stored in the memory or adjusting the intermediate data value in response to an external control signal;

a digital-to-analog (D/A) converter converting the intermediate data value into an analog voltage value corresponding to the intermediate data value when the intermediate data value read from the memory during a read operation is a maximum or minimum value of n-bit data; and an output unit amplifying the analog voltage value, wherein the control signal is a pulsed signal having logic high and low levels with respect to a predetermined voltage.

4. The automatic digital variable resistor of claim 3, wherein the digital-to-analog (D/A) converter comprises a data converter that forcibly-converts the maximum or minimum data value of n-bit data into an intermediate data value.

5. An automatic digital variable resistor comprising:

a programmable memory in which an intermediate data value of n bit data is stored, wherein n≧2;

an interface controller reading the intermediate data value stored in the memory or adjusting the intermediate data value in response to a control signal;

an error detector adjusting the intermediate data value to an adjusted intermediate data value of n-bit data when the intermediate data value read from the memory is a maximum or minimum value of n-bit data; and a digital-to-analog (D/A) converter outputting an analog voltage value corresponding to the read or adjusted intermediate data value; and an output unit amplifying the analog voltage value.

6. The automatic digital variable resistor of claim 5, wherein the error detector comprises:

a data detector outputting a logic high signal when the read intermediate data value is the maximum or minimum value of n-bit data or outputting a logic low signal when the read intermediate data value is neither the maximum nor minimum value of n-bit data; and a data decoder inverting all bits of the read intermediate data value except for the most significant bit (MSB) and outputting a resultant value when the logic high signal is output, or outputting the read intermediate data value when the logic low signal is output.

7. The automatic digital variable resistor of claim 5, wherein the control signal is a pulsed signal having logic high and low levels with respect to a predetermined voltage.

8. The automatic digital variable resistor of claim 5, wherein the memory is an electrically erasable programmable read only memory (EEPROM).

9. A liquid crystal display (LCD) comprising:

an LCD panel including a plurality of gate lines, a plurality of data lines intersecting the plurality of gate lines, and a plurality of pixels electrically connected to the plurality of data lines;

a timing controller generating control signals controlling the liquid crystal panel;

a driving voltage generator including an automatic digital variable resistor, which generates a plurality of driving voltages in response to the control signals received from the timing controller, wherein the automatic digital variable resistor comprises:

a programmable memory in which an intermediate value of n-bit data is stored, wherein n≧2; and a voltage adjuster adjusting the intermediate value stored in the memory in response to a control signal and outputting an analog voltage value corresponding to the adjusted intermediate value, wherein the voltage adjuster further outputs an analog voltage value corresponding to the intermediate value when the intermediate value read from the memory during a read operation is a maximum or minimum value of n-bit data; and a gate driver receiving the driving voltages and applying the driving voltages to the plurality of gate lines, wherein the control signal is a pulsed signal having logic high and low levels with respect to a predetermined voltage.

10. The LCD of claim 9, wherein the memory is an electrically erasable programmable read only memory (EEPROM).

11. A liquid crystal display (LCD) comprising:

an LCD panel including a plurality of gate lines, a plurality of data lines intersecting the plurality of gate lines, and a plurality of pixels electrically connected to the plurality of data lines;

a timing controller that generates control signals controlling the LCD panel;

a driving voltage generator including an automatic digital variable resistor, which generates a plurality of driving voltages in response to the control signals received from the timing controller, wherein the automatic digital variable resistor comprises:

a programmable memory in which an intermediate value of n-bit data is stored, wherein n≧2; and an interface controller that reads the intermediate data value stored in the memory or adjusts the intermediate data value in response to a control signal;

a digital-to-analog (D/A) converter that outputs an analog voltage value corresponding to the adjusted intermediate data value, and outputs an analog voltage value corresponding to the read intermediate data value when the read intermediate data value is a maximum or minimum value of n-bit data; and an output unit amplifying an analog voltage value; and a gate driver that receives the driving voltages and applies the driving voltages to the plurality of gate lines, wherein the control signal is a pulsed signal having logic high and low levels with respect to a predetermined voltage.

12. The LCD of claim 11, wherein the digital-to-analog (D/A) converter comprises a data converter that converts the maximum or minimum data value of n-bit data into an intermediate data value.

13. A liquid crystal display (LCD) comprising:

a liquid crystal panel including a plurality of gate lines, a plurality of data lines intersecting the plurality of gate lines, and a plurality of pixels electrically connected to the plurality of data lines;

a timing controller that generates control signals controlling the liquid crystal panel;

a driving voltage generator including an automatic digital variable resistor, which generates a plurality of driving voltages in response to the control signals received from the timing controller, the automatic digital variable resistor including:

a programmable memory in which an intermediate value of n-bit data is stored, wherein n≧2, an interface controller that reads the intermediate data value stored in the memory or adjusts the intermediate data value in response to a control signal;

an error detector that adjusts the intermediate data value to an adjusted intermediate data value of n-bit data when the intermediate data value read from the memory is a maximum or minimum value of n-bit data; a digital-to-analog (D/A) converter that outputs an analog voltage value corresponding to the read or adjusted intermediate data value; and an output unit amplifying the analog voltage value; and a gate driver that receives the driving voltages and applies the driving voltages to the plurality of gate lines.

14. The LCD of claim 13, wherein the control signal is a pulsed signal having logic high and low levels with respect to a predetermined voltage.

15. The LCD of claim 13, wherein the memory is an electrically erasable programmable read only memory (EEPROM).

* * * * *